US005357699A

United States Patent [19]

Padawer

[11] Patent Number: 5,357,699

[45] Date of Patent: Oct. 25, 1994

[54] ERGONOMICALLY ADJUSTABLE NEEDLECRAFT SUPPORT STRUCTURE

[76] Inventor: Robert S. Padawer, 2208 S. Elder Cir., Broken Arrow, Okla. 74012

[21] Appl. No.: 25,664

[22] Filed: Mar. 3, 1993

[51] Int. Cl.[5] ..... D05C 1/00; D06C 3/08; A47B 57/08

[52] U.S. Cl. ..... 38/102; 248/124

[58] Field of Search ..... 38/102, 102.2, 102.4, 38/102.5, 102.9; 248/122, 278, 444; 108/4, 43, 48; 269/51

[56] References Cited

U.S. PATENT DOCUMENTS

| | | | |
|---|---|---|---|
| 2,464,690 | 3/1949 | Ketchem | 108/4 X |
| 2,664,142 | 12/1953 | Scheuerman et al. | 248/124 |
| 2,765,999 | 10/1956 | Baker | 248/124 |
| 3,091,343 | 5/1963 | Neumann | 248/124 X |
| 3,174,326 | 11/1973 | Selden | 38/102.4 |
| 3,709,585 | 1/1973 | Tsai | 248/124 X |
| 3,899,164 | 8/1975 | Newman | 269/771 |
| 3,906,648 | 9/1975 | Bard | 38/102.2 |
| 3,938,267 | 2/1976 | Bard | 38/102.1 |
| 3,955,722 | 5/1976 | Bard | 223/106 |
| 4,102,065 | 7/1978 | Selden | 38/102.1 |
| 4,175,343 | 11/1979 | Mathews | 38/102.1 |
| 4,229,890 | 10/1980 | Dropinski | 38/102.1 |
| 4,292,748 | 10/1981 | Miller | 38/102 |
| 4,378,646 | 4/1983 | Mazeika | 38/102 |
| 4,544,120 | 10/1985 | Lowell et al. | 248/122 |
| 4,590,695 | 5/1986 | McGillivry | 38/102.2 |
| 4,660,814 | 4/1987 | Shader | 38/102.2 X |
| 4,726,552 | 2/1988 | Warshawsky | 248/122 |
| 5,023,755 | 6/1991 | Rosenberg | 248/124 X |
| 5,027,989 | 7/1991 | Nevius | 223/120 |

OTHER PUBLICATIONS

Gazelle, Needlework Stand, Jul. 1993.

*Primary Examiner*—Clifford D. Crowder
*Assistant Examiner*—Ismall Izaguirre

[57] ABSTRACT

A free-standing, ergonomically adaptable support stand for needleworkers and similar craftspersons has a single support leg, which may be arranged for positioning on either the right or left of a seated artisan, an adjustable work support arm, a rotatable work holding clamp and an adjustable pattern holder. A floor-mounted base, which may be placed to the right or left of the legs of a seated artist, has a portion which passes under the chair and allows a work piece to be conveniently positioned without obstruction to the feet or legs and permits the craftsperson to sit in a comfortable and relaxed position. All movable parts are provided with friction adjustments which, once set, require little attention. Being of wooden construction, the stand is light-weight, easily managable and maintenance-free.

20 Claims, 3 Drawing Sheets

ERGONOMICALLY ADJUSTABLE NEEDLECRAFT SUPPORT STRUCTURE

BACKGROUND OF THE INVENTION

The recent and continuing growth of interest and the expanded participation of individual practitioners in the arts and handicrafts has resulted in a proliferation of designs, devices and apparatus to aid in the practice of these arts. Notable among these apparatus are those which seek to enhance the capabilities of these practitioners by providing a wide variety of methods of support of work-pieces and work-piece holders to allow greater productivity while reducing the physical effort required in their practice. Among these are a number of devices which are intended to aid in the practice of the art of needlecraft.

While most of the practitioners of these arts and crafts are able-bodied and capable of prolonged physical activity, many are not. As an example, individuals involved in the physical and occupational therapy communities long ago discovered that, in many cases, the practice of needlecraft is of great benefit when employed in the rehabilitation programs of individuals who have sustained injury or suffered incapacitating illness as it provides excellent hand-eye coordination excercise and dexterity training without requiring physical exertion, which may be contra-indicated. Individuals so afflicted tend to derive the greatest benefit from this activity when the pieces upon which they work are adequately supported in such a manner as to permit a relaxed and comfortable posture. The same is true of fully capable, able-bodied practitioners.

Several examples of support structures and work-piece holders which, in one manner or another, have attempted to address the problem of convenient, adjustable support of these work-piece holders to allow positioning of the work-piece to a location convenient to the artist, are found in the prior art. A typical work-piece holder or needlework scroll frame is illustrated in the disclosure by Selden in U.S. Pat. No. 3,774,326 wherein two dowels having flattened areas adjacent the ends thereof are engaged within accomodating slots provided in adjustable side rails, thereby allowing the periodic advancement of the work-piece as work progresses on the fabric. Other styles of work-piece holders employing non-adjustable side rails are also provided with rotatable dowels for fabric supply, advancement and tensioning through the provision of frictional or gripping rotation inhibiting means. It is readily observable that such frames, lacking a means for their own support, present a cumbersome means for accomplishing fine needlework, as both hands of the artist are required in its accomplishment. Immediately following the emergence of these larger frames came the development of a number of frame holding easels and stands for their support in such a manner as to make them more convenient and "at-hand." Such support structures were the subject of a number of disclosures, commencing in the mid 1970's, covering a wide range of applications.

Among examples of these support structures, found in the prior art, are an "Adjustable Floor Support for Needlecraft and Art Frames," for which U.S. Pat. No. 3,899,164 was awarded to Raymond Newman, which led the way and was followed in rapid succession by U.S. Pat. Nos. 3,906,648, 3,938,267 and 3,955,722 to Bard; 4,102,065 to Selden; 4,175,343 to Mathews; 4,229,890 to Dropinski; 4,292,748 to Miller; 4,378,646 to Mazeika; 4,590,695 to McGillivray; and 5,027,989 to Nevius.

Each of these inventors has attempted to bring the work closer-to-hand or enhance the convenience and comfort of the needleworker and to provide a stable base upon which to mount needlework or similar frames and each has, to a certain extent, succeeded in so doing. None, however, have addressed the problems associated with ergonomic accomodation.

In order for a device to be ergonomically correct, it must not only accomodate the needs of each individual who will use it; it must not only be possible for the individual user to adjust the device to conform to his or her individual requirements; it must be so designed and constructed as to permit the user to quickly and easily configure and/or reconfigure the device to accomodate the user's changing requirements. For example, if an individual is seated in a chair performing needlework or a similar function and it becomes necessary to leave the seated position, an ergonomically correct device will accomodate this requirement without the necessity of tampering with or changing a number of adjustments. It will be readily observed that the structures of the prior art, while supporting and holding the work-pieces in a position substantially over the lap of a seated artisan, also effectively trap or lock the artisan in the chair in such a manner that it becomes necessary to move the chair away from the support structure in order to exit the chair. In the event that the chair is of the large, comfortable arm-chair style, of the type generally preferred by persons engaging in this activity, it's weight and bulk may make impossible for those of limited physical capability to extricate themselves without assistance. Other of the above cited designs rely solely upon the weight of the craftsman, seated upon the base portion of the support structure, to maintain the work-piece in the desired position, thus making the user a "part" of the device and magnifying the effort required to extricate one's self from engagement therewith. The utility of many of the devices of the prior art is further diminished as many persons prefer to sit in a cross-legged position while accomplishing this art work; a position which is unassumable when using a stand having a single centrally located support leg, as the support leg must pass between the knees of the seated individual. It will also be noted in the prior art that diverse means are employed for clamping, attaching or otherwise retaining the work-piece frames in position relative to the various support assemblies, most of which employ a plurality of threaded bolts, acting upon clamping members of various constructions, which either grip the periphery of the work-piece holder frames or by fasteners which pass through the side-rails of said frames. While each of the examples of the prior art possess merit and provide useful assistance in the accomplishment of needlecraft and similar art work, they do not address, anticipate or suggest the solution to the problem which the present invention is expressly created to solve.

SUMMARY OF THE INVENTION

The present invention provides an ergonomically correct, floor-mounted support structure and work-piece holder adapted to permit a needlecrafter to be seated in a comfortable and relaxed position, while having the needlework frame supported in a clamp, having self-alignment characteristics, conveniently positioned and secured directly before and under the hands of the artisan in such a mannner that the forward and rear surfaces of the work-piece are immediately accessable, yet without impedimenta in the form of legs or support members before the seated artisan which may be inhibitive of movement into or out of the chair; or the requirement for a particular positioning of the legs or body of the craftsperson while seated; and which allows the work-piece to be swung up and away from the working position, or returned thereto, without the requirement for adjustment of tensioning knobs or other retentive devices. The construction of the present invention is contrived to permit its assembly in either a right or a left-handed manner to adapt it to more conveniently serve the needs of oppositely handed persons; and has one support base member of a reduced vertical dimension, allowing it to pass under chairs or sofas having limited clearance between their bases and the floor upon which they rest, to permit rapprochement of the vertical member of the structure and the forward face of the seating surface. The present invention further includes a pattern or book holder having a "swing-away" feature, which is adjustably and removably attached to the vertical support column of the structure. The present invention combines all of the above features in an easily employed, ergonomically correct structure; which may be easily assembled for use or dis-assembled for transport or storage by persons of limited skill; and which is aesthetically compatible with a wide variety of decor.

A BRIEF DESCRIPTION OF THE DRAWING FIGURES

THE PREFERRED EMBODIMENT OF THE INVENTION

Figure 1:
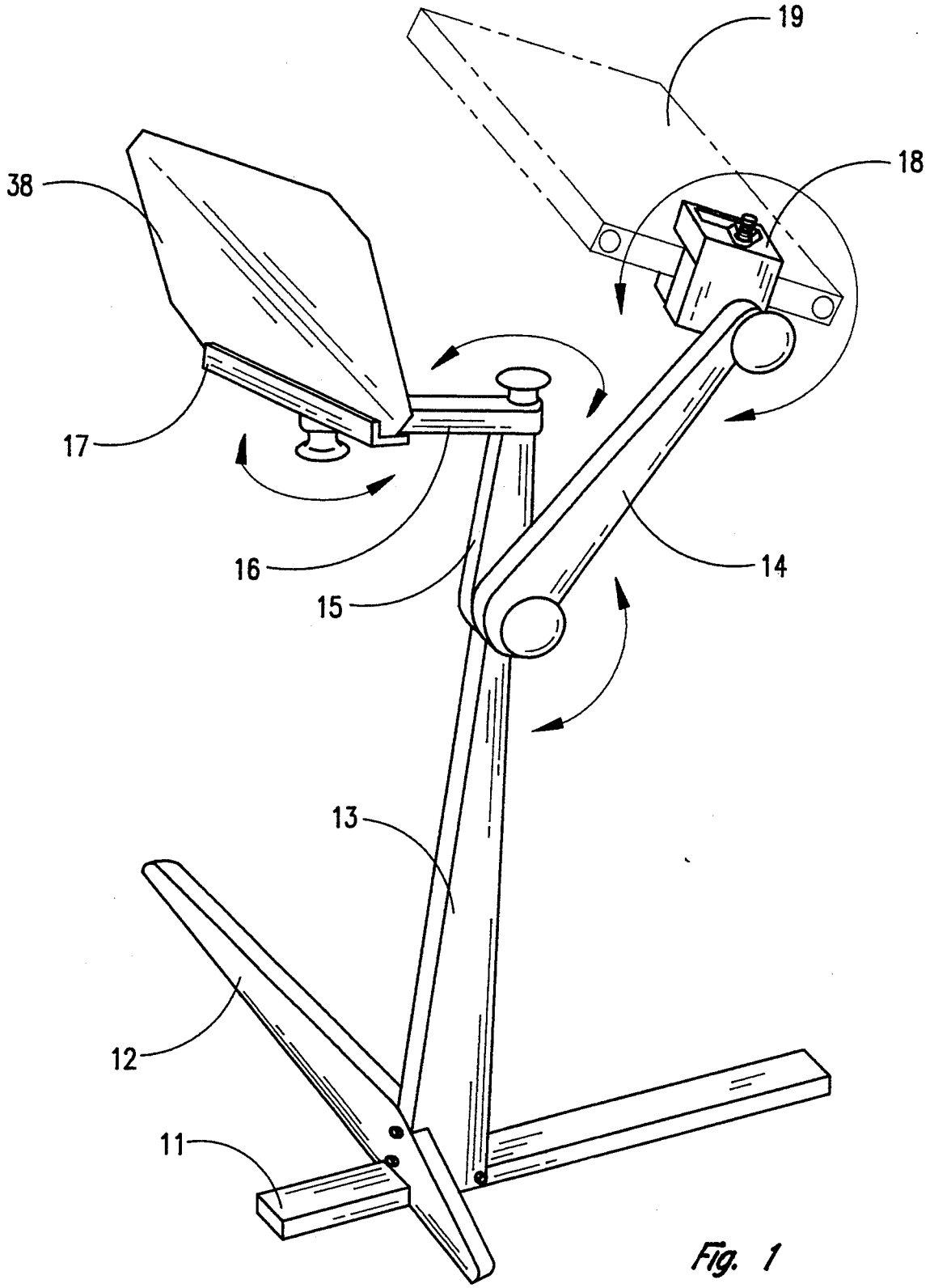
FIG. 1 is an overall perspective view of the complete support structure illustrating the components adjusted to the average working position having the base members assembled to position the structure to the left of a right-handed craftsperson.

Referring now, in greater detail to the figures of the drawings will disclose the preferred embodiment of the present invention as a structure for providing stable support of patterns and work-piece holders such as are employed in the accomplishment of needlecraft and similar arts, in a manner which is compatible with the ergonomic requirements of a variety of different individuals. In FIG. 1, which is a general overall perspective view of the complete support structure, the components of which are entirely of a flat wooden construction, is illustrated as being composed of a base comprising a horizontally situate, longitudinal, fore and aft base member 11 of a substantially rectangular configuration having a low profile, so configured to pass subjacent the base of a chair or other seating appliance, said member 11 extending rearwardly to a length greater than that of the angularly departing work-piece support arm 14 when said support arm is in a horizontal rearwardly extended position; a horizontally situate transverse stabilizing member 12 substantially in the form of a low profile or flattened scalene triangle, being truncated and slightly rounded prior to arrival at the the apex and at the opposing ends thereof; and a vertical support leg member 13 of a slender right triangular configuration being truncated and rounded at a point short of arrival at the apex thereof, said support leg member 13 extending vertically to a point of conjunction, proximate the rounded apex thereof, with angularly departing adjustable support arm 14 and extension member 15. Said adjustable support arm 14 being of a similar tapered or triangular configuration is rounded at the base or lower end thereof and extends outwardly to a point of rounded truncation at the distal end thereof. Extension member 15 being of a similar rounded base and slender triangular construction extends vertically from its point of conjunction with vertical support leg member 13 and adjustable support arm 14 and is squarely truncated at the distal end thereof at the point of abutment with swivel arm 16. Swivel arm 16, being of a flat rectangular configuration extends outwardly to a point of conjunction with the base of book or pattern holder 17. Adjustable support arm 14 extends outwardly from the juncture of vertical support leg member 13 and extension member 15 to a point proximate the distal end thereof where it supports a rotatable work-piece holder clamp, generally designated as 18 which supports and retains a work-piece holder 19. This FIGURE is illustrative only of the major components of the invention and of their basic relationships and functions. The means of their conjoinment and details of their construction are addressed and further illustrated and described with reference to other of the figures of the drawings.

Figure 2:
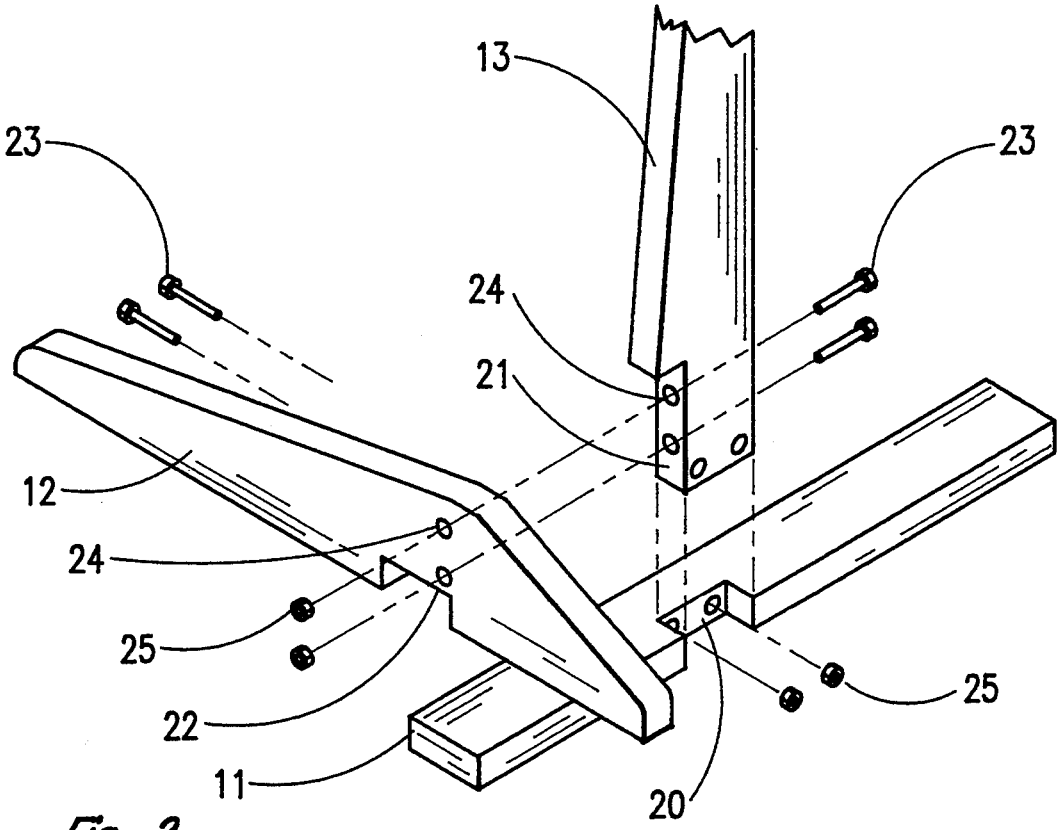
FIG. 2 is an exploded isometric view of the juncture of the base members and vertical support member and the manner in which they are assembled for positioning the support structure to the left of the seated user.
Figure 3:
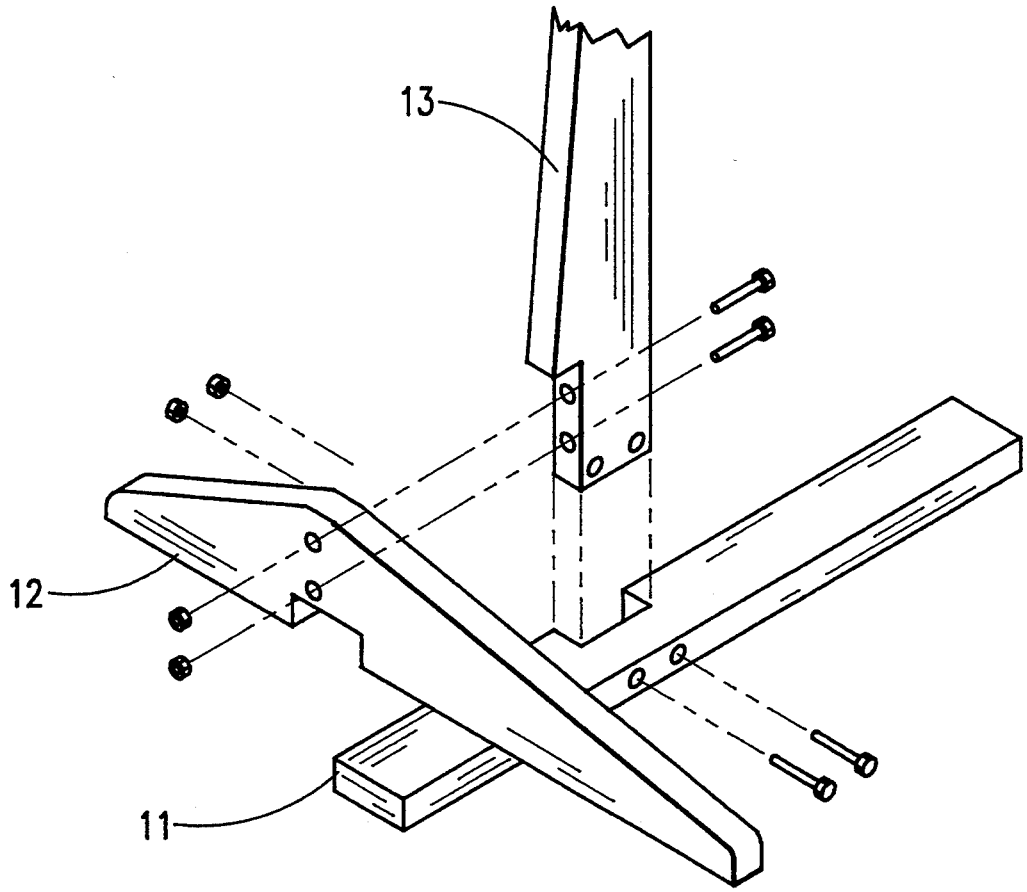
FIG. 3 is an exploded isometric view of the juncture of the base members and vertical support member and the manner in which they are assembled for positioning the support structure to the right of the seated user.
Figure 4:
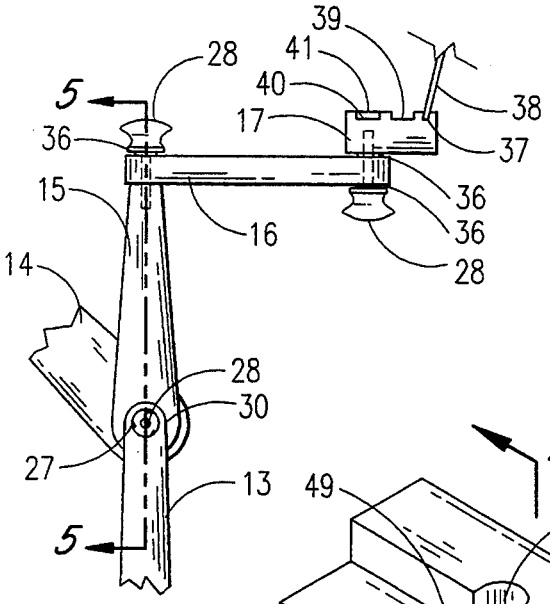
FIG. 4 is a partial elevational view of the vertical support member, the extension member and pattern holder assembly and the angularly departing work support arm in their assembled configuration as seen from the side opposite that of FIG. 1.
Figure 5:
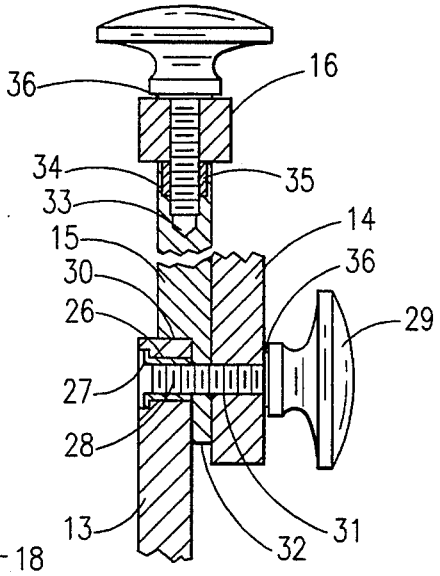
FIG. 5 is a sectionalized detail view of the assembly of FIG. 4 taken at line 5—5, viewed in the direction of the arrows showing the concealed internally threaded devices employed.

FIG. 2 is illustrative of the manner in which the longitudinal base member 11, the transverse base member 12 and the vertical support leg member 13 are constructed and the manner in which they are conjoined to provide a support structure configured to accomodate the needs of a right-handed needlecrafter, id est, with the support structure arranged to be to the left of the legs of the seated artisan. It will be noted that the longitudinal base member 11 is adapted, by means of a dimensioned cut-out portion 20 to closely accommodate a portion of reduced breadth 21 of the lower end of vertical support leg member 13, said portion of reduced breadth of member 13 being of a vertical dimension to be accommodative and allowable of the entry thereinto of transverse base member 12. Transverse base member 12 is also provided with a dimensioned cut-out portion 22 in the lower edge thereof, said cut-out portion being adapted to closely accomodate the breadth of longitudinal base member 11 and being of a depth equal to the vertical dimension or thickness of said longitudinal base member 11. The three components are thus configured for mating engagement, each with the others, to form a snugly interlocking juncture which is further secured by means of machine screws 23, which are typical, which pass through typical dimensioned bores 24 and are drawn tightly into engagement with internally threaded machine nuts 25, said nuts also being typical. Flat washers (not shown) may be installed under the heads of the machine screws and under the nuts to prevent the abrasion of the wooden components as the screws and nuts are drawn into tightly gripping engagement. In the most preferred embodiment a counter-bore is provided in each of the dimensioned bores 24 to allow the nuts to be flush with the flat face of the wooden members and hollow-head machine screws of the "Allen" *tm.* variety are employed to obviate the possibility of "snagging" at this point. FIG. 3 depicts the longitudinal base member 11, transverse base member 12 and vertical support leg member 13 in the reverse position as they are assembled to accommodate a left-handed person by placing the vertical support leg member 13 to the right of the legs of the seated individual by inverting the longitudinal base member 11 and the reversal of the positioning of the transverse base member 12. As assembly and securement is essentially identical to that required to accommodate a right-handed person, this illustration is essentially self-explanatory. FIGS. 4 and 5 are illustrative of the manner of conjoinment of the various components at and above their point of conjunction at the upper extremity of vertical support leg member 13 wherein a dimensioned bore 26 is provided at a point proximate the center of the radius of the upper rounded end thereof, said bore being provided with a typical internally threaded metallic insert 27 (commercially known as a "T-nut") adapted to receive a correspondingly threaded metallic screw 28, said screw having, in lieu of a conventional hexagonal head, a fixedly attached knob 29 of a plastic, metallic or wooden construction, at the distal end thereof, to adapt said threaded metallic screw for convenient manual adjustment without the employment of tools. (Note: For purposes of simplification and clarification, the combination of screw and knob are typical of those employed at all points in the invention where adjustment is provided and as such will hereinafter be referenced simply as "adjustment screw 28" which shall imply the combination of the two elements, threaded screw and knob, hereinabove detailed.) The lower end of extension member 15 is provided with a saddle-like partially cut-out portion 30, which closely accommodates the entry thereinto of the upper end of vertical support leg member 13 and comprises a dimensioned bore 26 at a point proximate the center of the radius of the rounded end thereof to permit the passage therethrough of adjustment screw 28. Adjustable support arm member 14 is also provided with a dimensioned bore 31 at the lower end thereof, said bore being at a point proximate the center of the radius of the rounded end thereof and being of a dimension to closely accommodate the passage therethrough of adjustment screw 28. This configuration, by virtue of the cut-out portion 30 of extension member 15 astride and closely fitting the upper extremity of vertical support leg member 13, will be seen to be inhibitive of axial rotation of extension member 15 while lateral movement is prevented by the non-cut-out portion 32 adjacent the saddle-like portion 30 in engagement with the flat side of vertical support member 13 and opposing engagement with the inner flat surface of adjustable work-piece support arm 14 which is in adjustable frictional engagement therewith by means of adjustment screw 28. The distal end of extension member 15 is squarely truncated and comprises at the center of the truncation a vertically disposed slightly undersized blind bore 33 dimensioned to tightly accommodate adjustment screw 28 in frictional engagement and a counter-bore 34 dimensioned to accommodate an externally and internally threaded device 35 such as a "Sta Fast" Series IB threaded insert, said device being fixedly installed within said counter-bore 34 and being correspondingly threaded internally to receive adjustment screw 28, the threaded portion of which passes through flat washer 36 (typical) and a closely dimensioned transverse vertical bore situate the center of the width and proximate the end of short, rectangularly configured swivel arm 16 and into threaded engagement with said internally threaded device 35. Flat washers 36 interposed between swivel arm 16 and adjustment screw 28 permit movement of the said swivel arm without alteration of the adjustment of screw 28. Adjustment screw 28 passes through said threaded device and into frictional engagement with slightly undersized bore 33 and is thereby inhibited from rotation as the swivel arm 16 is moved thus maintaining the desired frictional drag and thereby obviating the requirement for frequent re-adjustment. (Note: This manner of conjoinment, the use of undersized boring to provide frictional adjustment retention and the employment of the "Sta Fast" threaded insert in a corresponding counter-bore is typical of all adjustment points of the invention, with the singular exception of the point of conjunction of members 13, 14 and 15, at which point a "T-nut" is employed.) Swivel arm 16 extends outwardly from its point of frictionally adjustable attachment to extension member 15 and has proximate the distal end thereof an additional vertically disposed transverse dimensioned bore. A pattern or book holder 17 of a substantially rectangular configuration, comprising a primary angularly disposed longitudinal slot 37 adapted to receive a thin laminated wooden pattern rest member 38, a secondary longitudinal slot of a greater lateral dimension 39 which serves to prevent a pattern from sliding displacement and a tertiary longitudinal slot of a similar lateral dimension 40 which serves as a containment for an adhesively retained sheet cork needle holder 41. Said pattern holder 17 further comprises a dimensioned blind bore (not shown) at the longitudinal center thereof which contains a typical internally threaded metallic device as hereinabove described (See FIG. 5) said bore being correspondent with the bore proximate the outer end of swivel arm 16 through which passes adjustment screw 28 into threaded engagement with the said internally threaded device of pattern holder 17 thereby bringing the swivel arm 16 and pattern holder 17 into mechanical attachment and adjustable frictional engagement as hereinabove described. Flat washers 36 interposed between the base of pattern holder member 17 and swivel arm 16 and beneath the head of adjustment screw 28 permit rotation of pattern holder 17 without altering the setting of adjustment screw 28.

Figure 6:
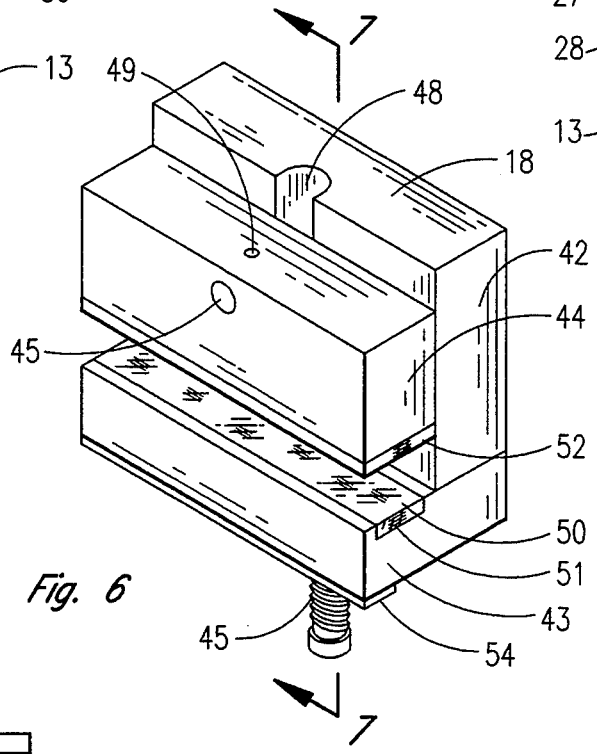
FIG. 6 is an inverted view of the work-piece holder clamp.
Figure 7:
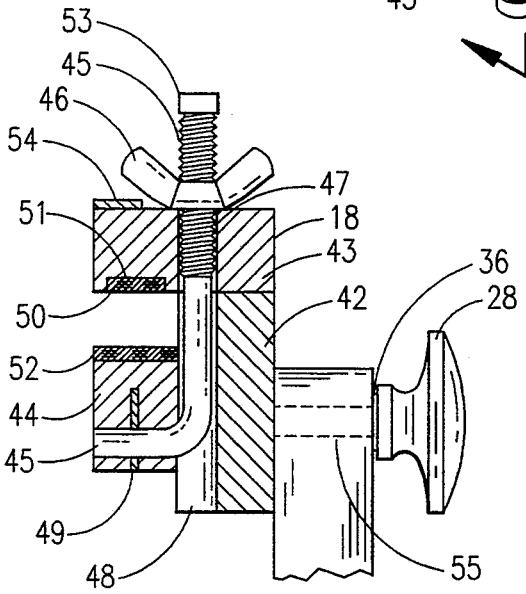
FIG. 7 is a sectional view of the clamp illustrated in FIG. 6, in the upright position, taken at line 7—7, viewed in the direction of the arrows.
Figure 8:
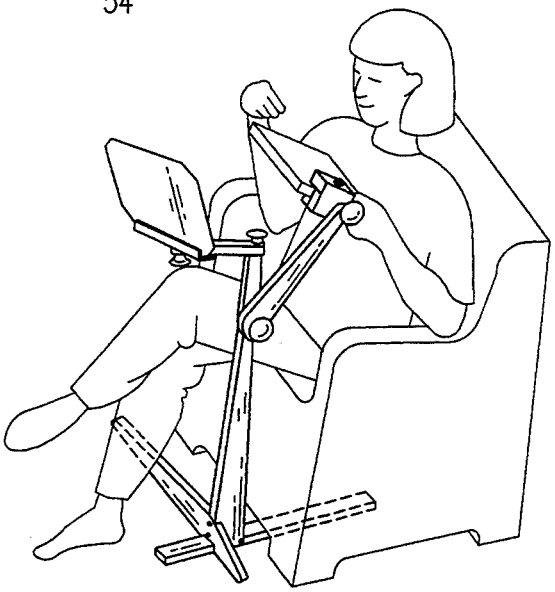
FIG. 8 illustrates the positioning of the complete support structure as it is employed by a right-handed person and the manner in which the rearward extending base member passes under the forward edge of a chair permitting the bringing together of the vertical support member of the structure and the forward face of the chair and the relaxed posture that may be assumed by one using the apparatus.

Adjustable support arm 14, the lower end of which is in frictionally adjustable engagement with extension member 15 and vertical support leg member 13, has proximate the distal end thereof a dimensioned bore which passes transversely therethrough at a point defined by the center of the radius of the rounded end thereof. A typical adjustment screw 28 passes through said bore into mechanical and frictional engagement with work-piece holder clamp 18 in the typical manner hereinbefore described and illustrated in FIG. 5. Said clamp, generally designated as 18, which is illustrated isometrically, in an inverted position in FIG. 6 and sectionally in an upright position in FIG. 7, is of a wooden construction basically comprising a back portion 42 and a fixed jaw 43 which are fixedly joined by screws and adhesive or any other suitable means, a movable jaw 44 and a threaded "L" bolt 45 and wing-nut 46. The clamp is constructed much in the manner of a conventional bench-vise with, one notable exception; the bench-vise is configured in such a manner as to assure that the fixed and movable jaws come together squarely in a parallel relationship; conversely, the clamp of the present invention is adapted to allow the jaws to come together slightly out-of-parallelism in order to tightly grip objects which are of a slightly tapered or irregular configuration. This is accomplished by the provision of a slightly oversized bore 47 through fixed jaw 43 which communicates with a centrally situate guide slot 48 which is machined into the inner surface of the back portion 42. Said guide slot being of a lateral dimension somewhat greater than the diameter of "L-bolt" 45 allows the lateral movement of said "L-bolt" therein. Movable jaw 44 comprises a transverse bore therethrough dimensioned to closely accommodate the lower or short portion of "L-bolt" 45 which passes transversely through said jaw 44 and terminates at the forward or outer face thereof. Said jaw being fixedly attached to said lower portion of said "L-bolt" by roll-pin 49 which passes through accommodating bores provided in said jaw and said "L-bolt" is thereby inhibited from departure from, or rotation upon, said "L-bolt." Being thus attached said movable jaw 44 is allowed to move in the short arcuate path described by the lower end of said "L-bolt" as it moves pivotally from the point of contact of the clamp tightening wing-nut 46 with fixed jaw 43 thus adapting said clamp to allow the retention of slightly tapered or irregularly formed work-piece holders upon tightening of wing-nut 46. The adaptive and retentive capability of said work-piece holding clamp is further enhanced by the provision of jaw liner 50, composed of a sheet cork material, which is adhesively attached within the confines of a wide longitudinal recess 51 provided therefor in the inner face of fixed jaw 43 and a liner 52 of a like material adhesively secured upon the corresponding face of movable jaw 44. A wing-nut stop 53 of a plastic or similar material is provided at the extremital threaded end of "L-bolt" 45 to prevent the accidental excursion therefrom and possible loss of said wing-nut. An adhesively attached narrow rectangular permanent magnet 54 is provided on the outer face of fixed jaw 43 adjacent wind-nut 46 as a convenient needle holder. A typical internally threaded metallic device (not shown) is provided in the rear face of work-piece holder clamp 18 to allow the adjustable and rotational conjoinment thereof with the upper extremity of support arm 14 by the installation of adjustment screw 28 through bore 55 proximate the upper extremity of said support arm, said bore being situate the center of the radius of the rounded end of said support arm. This method of conjoinment permits the rotation or inversion of work-piece holder 19 about the axis of adjustment screw 28 to allow ready access to either the forward or reverse face of the work-piece and by virtue of the frictional engagement of adjustment screw 28 with the previously described undersized and snugly fitting bore 33 obviates the requirement for the constant adjustment thereof.

METHOD OF USE OF THE INVENTION

Following assembly of the base members of the support structure to accommodate the left or right hand requirement of the individual user and the assembly of the extension member, pattern holder, adjustable support arm and work-piece holder clamp, a work-piece holder may be installed and the clamp tightened to retain the work-piece holder securely in place, or if preferred the holder may be installed after the craftsperson is comfortably seated; the vertical support leg of the structure is drawn into close proximity with the forward edge of a chair or other seating appliance, causing the aft extending longitudinal base member to pass under the chair, the extremely low profile of said base member allowing its passage under chairs having minimal clearance betwixt their bases and the floor. The support arm is adjusted to place the work-piece in a convenient position and the frictional drag on the arm is adjusted to compensate the weight of the work-piece holder, the pattern holder is adjusted to the desired position and frictionally restrained from further movement and the craftsperson is ready to spend many comfortable hours in the pursuit of the craft. When access to the reverse side of the work-piece is required, it is only necessary to rotate the work-piece holder about the axis provided at the point of attachment of the work-piece holder clamp. Once established, the adjustments need not be changed as the work-piece may simply be raised and rotated away from the artist or the entire structure, being of a lightweight yet rigid construction, may easily be rotated away from the chair or pushed forward to permit unimpeded egress. As the adjustable components are frictionally restrained from movement and the adjustment means are also frictionally maintained, no further adjustment is required until changing work-pieces or craftspersons.

While there has herein been shown and described the presently preferred embodiment of this invention, it should be understood that such has been done for purposes of illustration only and that certain changes, modifications, alterations and adaptations may be made thereto within the scope of the appended claims.

What I claim is:

1. A free-standing, adjustable needlecraft support and pattern holding device of an ergonomically adaptable design, the improvement comprising in combination:

A) a three part base and leg assembly of a wooden construction comprising;

1) a first narrow longitudinal horizontal part, of a profile to permit passage under furniture, having a cut-out portion at approximately one-quarter of the length thereof for conjunctive engagement with;

2) a second transverse horizontally disposed stabilizing part, of a profile higher than said first part at approximately one-quarter of the length thereof a cut-out portion for mating engagement with said first part and;

3) a third vertically rising support leg part of a narrow isosceles triangular configuration, which is truncated and rounded at a point short of the apex thereof, the base of which is matingly engagable with said first part and said second part, said three parts being provided with corresponding bores therethrough to accommodate;

B) conjoinment means whereby said longitudinal transverse and vertical parts are joined together by a plurality of threaded mechanical fasteners passing through said corresponding bores to form a rigid unitary construction, said construction being configured for reversible assembly to accommodate the requirements of right or left handed persons further comprises;

C) a vertical extension member, having a saddle-like cut-out portion, including a dimensioned horizontal bore therethrough at the lower end thereof, providing for non-adjustable, cooperative attachment to, or removal from, the upper truncated and rounded extremity of said rising support leg, said vertical extension member having a vertical dimensioned bore provided with internal metallic threads at the center of the distal, or upper truncated end thereof, to accommodate the rotatable and frictionally adjustable and lockable attachment of;

D) a horizontal outwardly extending swivel arm, having a centralized, dimensioned, vertical bore adjacent the proximal end thereof, to accommodate the passage therethrough of a knobbed, externally threaded, metallic fastener into operable engagement with the said internal metallic threads of said vertical extension member, for it's rotatable and frictionally adjustable and lockable attachment, upon and to, said vertical extension member, said arm having adjacent the distal or opposing end thereof, a second vertical, dimensioned bore, passing through the center of its width to accommodate the passage therethrough, (from the opposing direction) of a second knobbed, externally threaded, metallic fastener provided for retention, operable engagement, rotation and frictional adjustment and locking of;

E) a book or pattern support having a correspondent dimensioned vertically disposed bore, comprising metallic internally threaded means therein, at the center of the length thereof, for operable engagement with the threaded end of said knobbed, externally threaded, metallic fastener means and is thereby mechanically engaged for retention, horizontal rotation upon, or frictional adjustable and locking to, said outwardly extending swivel arm;

F) an adjustable work support arm attached to, and extending outwardly from the point of conjunction with the upper extremity of said vertical support leg and said vertical extension member, said work support arm being angularly adjustable in the vertical plane and frictionally adjustable and lockable by threaded means, to accommodate the ergonomic, physical and comfort requirements of the user;

G) a work-piece holding clamp, comprising a fixed jaw having a cork-lined gripping surface and a screw-operated movable jaw having a similar gripping surface, movable in a short arcuate path, relative to said fixed jaw, to cooperatively grip irregular work-pieces, said clamp being attached in frictionally adjustable and lockable rotational engagement to the distal or outermost end of said work support arm;

H) the frictionally adjustable and lockable conjointment means comprising cooperative metallic, internally and externally threaded means.

2. The base assembly of claim 1 wherein the rearward length of said horizontally disposed longitudinal part is greater than the length of the angularly adjustable work-piece support arm when said support arm is at full rearward horizontal extension.

3. The base assembly of claim 1 wherein said first part and said second part are configured for mating engagement.

4. The base assembly of claim 1 wherein said first part and said second part are in mating engagement with said third part.

5. The base assembly of claim 1 wherein said first part and said second part are reversibly engageable with said third part.

6. The base assembly of claim 1 wherein the three base part thereof are mechanically conjoined by means of machine screws and corresponding nuts.

7. The base assembly of claim 6 wherein said conjoinment means comprises threaded metallic machine screws and correspondingly threaded nuts.

8. The base assembly of claim 7 wherein said threaded conjoinment means comprises counter-sunk hollow head machine screws and correspondingly threaded concealed nuts.

9. The vertical support leg part, vertical extension member and support arm member of claim 1 each are of truncated narrow isosceles triangle narrow isosceles triangular configuration.

10. The vertical support leg member of claim 1 wherein said roundly truncated uppermost end is provided with a dimensioned transverse bore comprising internal metallic threaded conjoinment and frictionally lockable means.

11. The vertical extension member of claim 1 wherein the cut-out saddle-like portion is configured to matingly engage the rounded truncation of the third part member.

12. The vertical extension member of claim 1 comprising a non-cut-out portion in frictional engagement with said vertical support member and said adjustable work support arm member.

13. The horizontal swivel arm of claim 1 wherein said arm extends horizontally outward from said vertical extension member and comprises operable frictionally engageable retention, adjustment and locking means.

14. The pattern support of claim 1 comprising frictionally engageable retention, adjustment and locking means.

15. The adjustable work-piece support arm of claim 1 wherein said arm is in frictional engagement with said third part and said vertical extension member by knobbed screw means passing through bores in said support arm member and said extension member, engaging the metallic internally threaded means of said third part.

16. The work-piece holding clamp of claim 1 wherein said clamp accommodates work-piece frames having nonparallel or unevenly configured edges.

17. The work-piece holding clamp of claim 1 wherein said clamp is rotatable about a clamp conjoinment axis.

18. The corresponding threaded conjoinment means of claim 1 comprising metallic externally threaded hollow headed machine screws and internally threaded machine nuts.

19. The frictional adjustment and locking means of claim 1 comprising concealed metallic internally threaded fasteners and externally threaded knobbed screws.

20. The frictional adjustment and locking means of claim 1 comprising slightly undersized bores, wherein the inner walls of said bores are in frictional engagement with the threads of said metallic externally threaded knobbed machine screws to impede their free rotation.

* * * * *